United States Patent [19]

Wilkinson

[11] 4,406,943

[45] Sep. 27, 1983

[54] TEMPERATURE SELF-LIMITING ELECTRIC FUEL OIL HEATER FOR OIL BURNER UNITS

[76] Inventor: Robert S. Wilkinson, Box 61, West Newfield, Me. 04095

[21] Appl. No.: 110,695

[22] Filed: Jan. 9, 1980

[51] Int. Cl.[3] ..... F23D 11/44; H05B 3/40; F24H 1/10

[52] U.S. Cl. ..... 219/301; 48/103; 123/549; 123/557; 219/206; 219/535; 222/146 HE; 222/135; 239/431; 431/208

[58] Field of Search ..... 219/296–299, 219/301–306, 308, 309, 205–208, 535; 222/146 AE, 146 R; 239/133, 135, 136; 431/208, 11, 28, 36–41, 207, 209–212, 103, 161, 162; 48/103, 65; 123/549, 557

[56] References Cited

U.S. PATENT DOCUMENTS

| | | | |
|---|---|---|---|
| 641,306 | 1/1900 | Lawton | 219/301 |
| 1,277,621 | 9/1918 | Macklind | 219/301 |
| 1,718,106 | 6/1929 | Bolsinger | 219/301 |
| 2,198,511 | 4/1940 | Hadjeff | 219/310 X |
| 2,211,380 | 8/1940 | Mikkelson | 219/301 X |
| 2,225,869 | 12/1940 | Janitschek | 219/301 |
| 2,255,318 | 9/1941 | Hawley | 431/28 |
| 2,346,506 | 4/1944 | Pulliam | 219/301 X |
| 2,355,693 | 8/1944 | Aldrich | 239/135 X |
| 2,397,988 | 4/1946 | Semminger | 219/301 X |
| 2,647,567 | 8/1953 | Cigla | 431/208 X |
| 2,726,715 | 12/1955 | Tegtmeyer | 431/208 |
| 2,876,830 | 3/1959 | Duy | 431/208 X |
| 3,090,420 | 5/1963 | Sacco | 431/208 X |
| 3,139,518 | 6/1964 | Gardener | 219/301 X |
| 3,238,990 | 3/1969 | Von Linde et al. | 431/208 X |
| 3,300,620 | 1/1967 | Ellis | 431/208 X |
| 3,326,262 | 6/1967 | Weller et al. | 431/208 X |
| 3,718,425 | 2/1973 | Weyl et al. | 431/208 X |
| 3,768,958 | 10/1973 | Sakai et al. | 431/208 |
| 4,008,041 | 2/1977 | Roffe et al. | 431/11 X |
| 4,192,988 | 3/1980 | Pederson et al. | 219/535 |
| 4,325,345 | 4/1982 | Wilkinson et al. | 219/301 UX |

FOREIGN PATENT DOCUMENTS

| | | | |
|---|---|---|---|
| 601158 | 12/1959 | Italy | 219/301 |

*Primary Examiner*—A. Bartis

*Attorney, Agent, or Firm*—Abbott Spear; Daniel H. Kane, Jr.

[57] ABSTRACT

A heating unit preheats and stabilizes No. 2 fuel oil delivered through a conduit to the nozzle of an oil burner for optimizing efficiency of combustion. The heating unit is generally formed around a section of oil conduit or other elongate tubular metal core (18) at least equal to the inside diameter of the oil delivery conduit in which it is to be incorporated. At least one coat or layer (20) of heat conducting electrically insulating porcelain-like cement is formed on the core. A helical heating element or coil (21) of high temperature alloy wire surrounds the layer (20) and core (18). The outside of the coil is covered by an electrical and thermal insulating second layer (22) of refractory-type cement of lower thermal conductivity than the porcelain-like cement. The entire unit may be housed in an elongate box (16) packed with high temperature insulation (27) and with high temperature double insulated lead wires (24, 25, 26) extending into the box from the secondary of a 12–14 volt, 4–7 amp transformer. In the preferred example the heating coil (21) comprises resistance wire of flat ribbon configuration of an alloy such as "Kanthol D", dimensioned to provide a total resistance in relation to the power supply so that the temperature of the coil is self limiting to the approximate range of from 70° F. (21° C.) to 175° F. (80° C.).

10 Claims, 7 Drawing Figures

TEMPERATURE SELF-LIMITING ELECTRIC FUEL OIL HEATER FOR OIL BURNER UNITS

CROSS-REFERENCE TO RELATED PATENT

This patent application is related to U.S. Pat. No. 4,325,345 issued Apr. 20, 1982 to Wilkinson et al.

BACKGROUND OF THE INVENTION

Oil arrives at the oil burner unit at various viscosity levels as a result of variations in the storage area temperature, variations within the oil itself and variation in temperature caused by the temperature of the oil when delivered.

As a consequence, it has been necessary to size the jet orifice of oil burner units to accommodate fuel oil the viscosity of which may be higher than what may be termed normal or desirable. While this ensures that the oil burner will function with fuel oil the viscosity of which is above normal or desirable, it results in increased fuel consumption per unit of time.

It has, of course, been recognized that if the storage tank for fuel oil is outside the building and above ground, provision should be made to heat it to ensure operation of the oil burner. It has also been recognized that there are advantages in vaporizing fuel oil but, as far as we are aware, there is no available system for controlling the temperature of No. 2 fuel oil either in terms of viscosity or of its vaporization that meets structural and functional requirements.

THE PRESENT INVENTION

The broad objectives of the present invention are to take advantage of the fact that, in general, by maintaining the fuel oil to a predetermined elevated temperature and sizing the jet orifice of the oil burner unit for the particular condition of the heated fuel oil, the per hour consuming rate is significantly reduced without loss of heating efficiency.

In accordance with that objective, the invention provides an oil heater including an elongated chamber incorporated in the fuel delivery conduit close to the oil burner unit, the chamber having a heating coil surrounding the flow path of the fuel and electrically insulated therefrom and electrically and thermally insulated from the exterior of the chamber. The coil is energized by current from the secondary of a 12–24 volt, 4–7 ampere transformer with the voltage and amperage of the current so related to the total resistance of the coil that the temperature of the coil is self-limiting to a selected temperature in the approximate range of from 70° F. to 225° where the conditioning of the fuel oil is in terms of viscosity and from 225° F. to 750° F. when the fuel oil is to be vaporized.

In more detail the invention contemplates providing a heating coil of resistive wire comprised of a high temperature durable alloy having a resistance per unit of length and an overall length selected to generate heat at a temperature in the chamber up to and including the vaporization temperature of the oil fuel fractions or constituents but below the flash point temperature of such constituents when the coil is coupled to the associated electrical power supply voltage. A feature and advantage of this arrangement is that the resistance wire heating coil is self limiting in temperature output attained at the applicable voltage of the power supply to a level at a safe margin below the flash point of the oil fractions.

The size of the orifice of a nozzle is determined by the deflection angle which ranges from 50° to 90° and depends on the maximum per hour fuel oil consumption rate for any particular installation. As this rate varies from 0.50 gallons per hour to 30 gallons per hour, there is a wide range in the temperature of the heating coil that is required to establish the temperature of the oil in the above referred-to range as the per hour oil consumption rate increases so must the coil temperature increase relative to the wanted oil temperature.

According to a specific embodiment of the invention adapted for use with 12–24 volt electrical power supplies, the resistance per unit length and overall length of the heating coil wire are selected to afford overall resistance of approximately two ohms. The heating coil resistance wire is preferably formed in a flat ribbon configuration to facilitate winding in spaced helical turns over the tubular chamber and to enhance thermal contact and heat delivery to the chamber. With a resistance of the wire in the vicinity of 0.8 ohms per foot and the wire of a length of twenty-five to forty inches and preferably thirty inches, we have found the heating coil to afford the preferred temperature range and temperature profile along a heating chamber approximately six inches in length with the inner diameter of the chamber in the range of five-sixteenths to one-half inch. By this attention to parameters and configurations, the temperature is self-limiting to a maximum of 1200° F. for a 12–24 volt system, even with the chamber empty or dry, thereby assuring a safe margin well below the flash temperature of the fuel oil under these conditions.

In this example, the core of the chamber is a length of a metal conduit incorporated in the fuel line upstream of the pump of the oil burner unit if the fuel is not to be vaporized and between the pump and the nozzle of the unit to enable the fuel oil to be vaporized if that mode of operation is wanted. The metal core is electrically insulated from the coil by high temperature durability, high thermal conductivity, electrically insulating material, and the heating coil is covered by electrically insulating material that desirably but not necessarily is of lower thermal conductivity than the inner layer of insulation.

According to yet a further aspect of the invention, the elongated heating chamber is within a box packed with high temperature insulation thermally insulating the oil heating chamber from the transformer which is spaced from the box with the coil leads from the secondary of the transformer mechanically secured to the ends of the coil wire within the box. Thermal conductivity between high and low temperature portions of the electrical circuit is minimized.

Other objects, features and advantages of the present invention will become apparent in the following specification and accompanying drawings.

BRIEF DESCRIPTION OF THE DRAWINGS

The drawings illustrate preferred embodiments of the invention of which

THE PREFERRED EMBODIMENTS OF THE INVENTION

Figure 1:
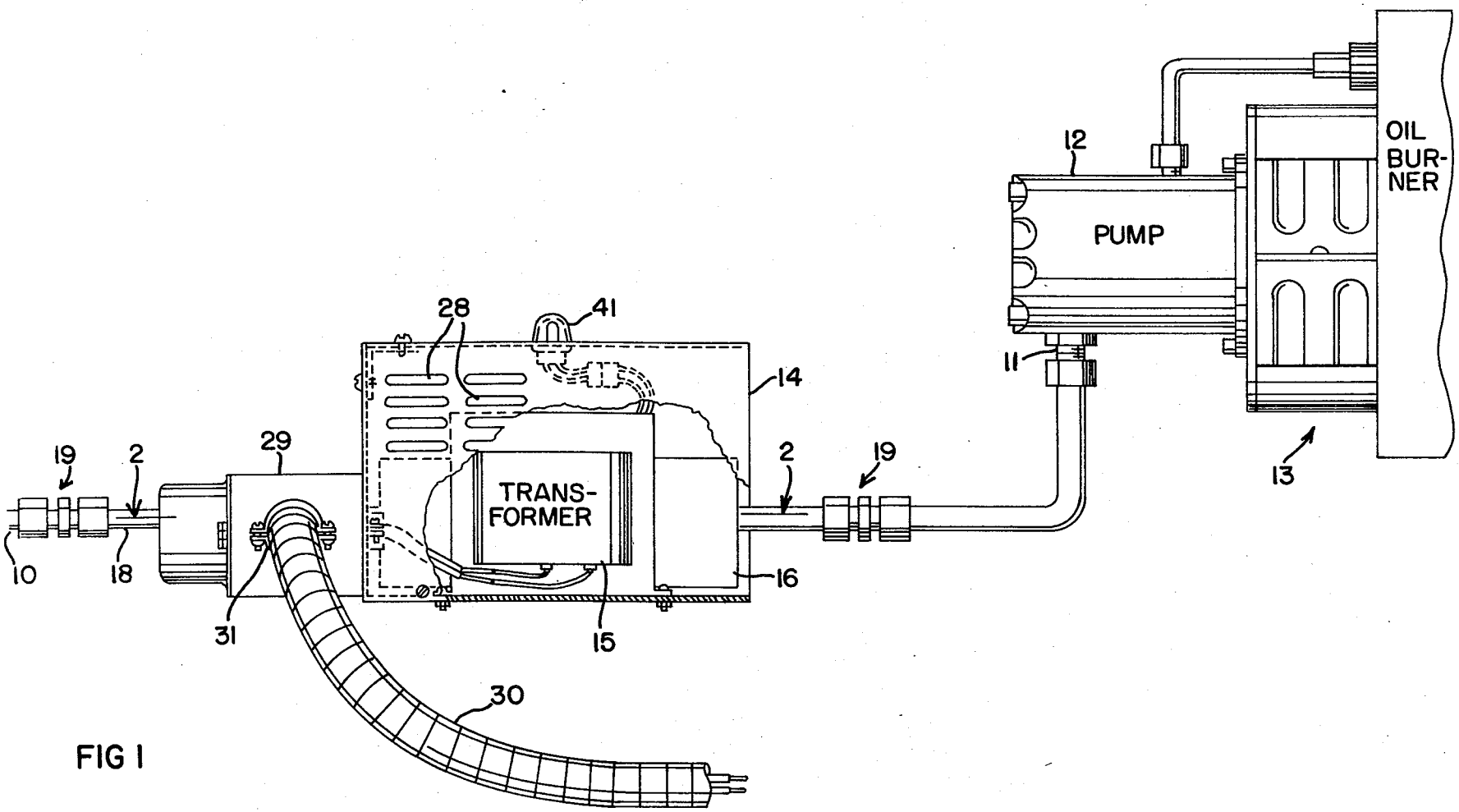
FIG. 1 is a side view of a typical oil burner installation with a heater in accordance with the invention incorporated in the fuel line to enable the viscosity of the fuel oil to be reduced to a predetermined value.

In the embodiment of the invention illustrated by FIGS. 1, 2, 2A and 2B the line 10 from the fuel oil tank, not shown, is connected to the inlet 11 of the pressure pump 12 of a conventional oil burner unit, generally indicated at 13.

A cabinet 14 houses a conventional 4 to 7 ampere, 12 to 24 volt AC transformer 15 and a metal box 16 containing the elongated heating chamber, generally indicated at 17. The heating chamber 17 has as its core a length of copper tubing 18 extending through the ends of the box 16 and of the cabinet 14 and incorporated in the line 10, the fittings used for that purpose indicated at 19. The tubular core 18 is shown as the same size as the line 10 which typically is three eighths of an inch tubing.

Figure 2:
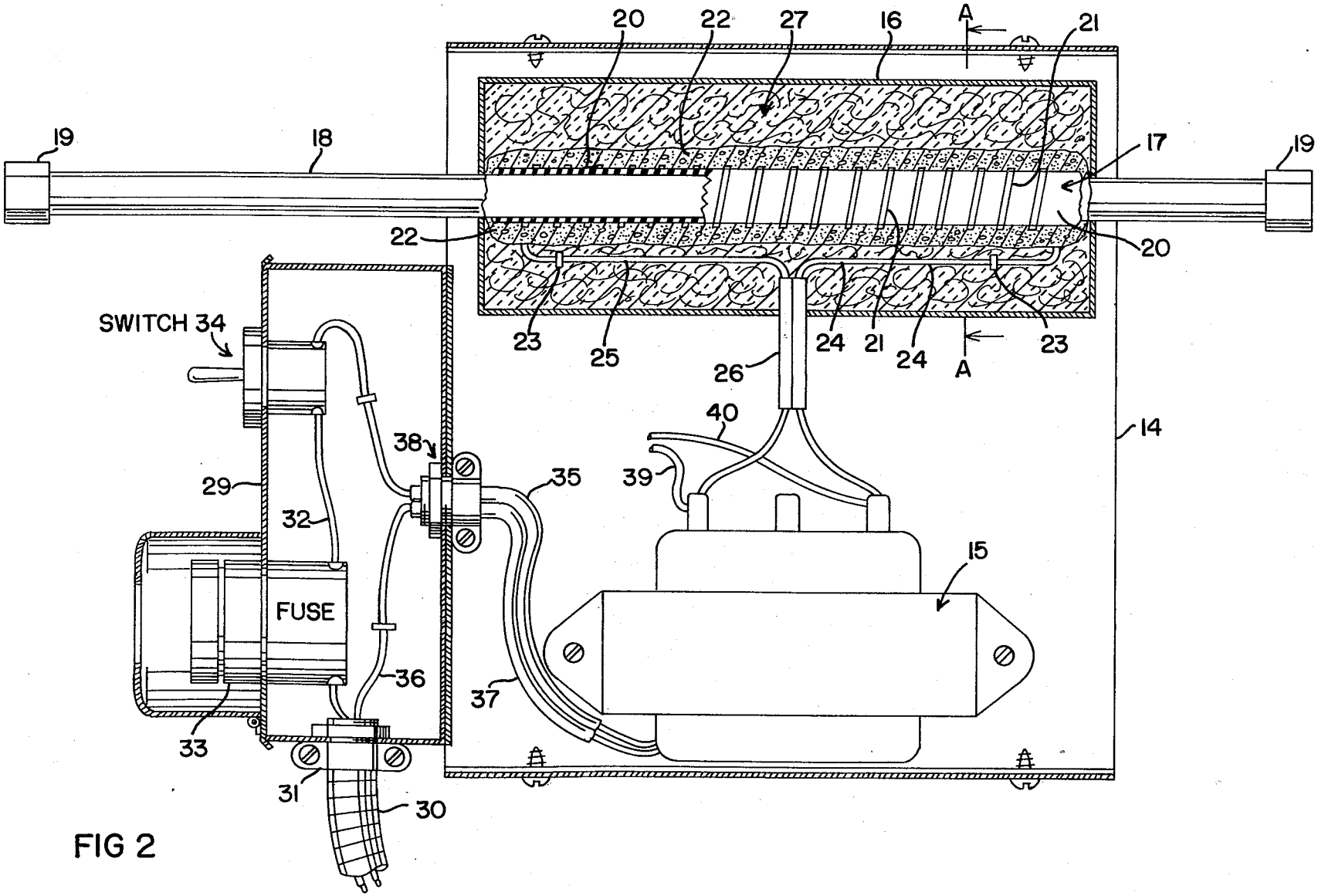
FIG. 2 is a partial section taken approximately along the indicated line 2—2 of FIG. 1 with the heating chamber 17 partially cut away to show the different layers on tubular core 18.

The portion of the core 18 of the heating chamber 17 within the box 16 is provided with a layer 20 of a durable, heat conductive electrical insulating material of which one example is coatings of Omega CC high temperature cement, made by Omega Engineering, Connecticut, a porcelain-like cement providing a layer thickness in the order of one-eighth of an inch. A length of heating wire is wound helically about the thus layered portion of the core 18 to form a heating coil 21 covered by a layer 22 of electrical insulation which need not exceed one-quarter of an inch in thickness but which may be thicker as shown in FIG. 2. A refractory cement may be used to form the outer layer 22. In practice, the coil forming wire is a nickel-chrome wire or equivalent and is in the form of a ribbon to facilitate winding and to provide maximum thermal contact.

Each end of the coil-forming wire is mechanically connected within the box 16 as at 23 to the appropriate one of the double insulated leads 24, 25 which extend from the box 16 through sheaths 26 and are connected to the secondary of the transformer 15. The box 16 is packed with high temperature insulation 27. For this purpose, insulation capable of withstanding a temperature as high as 2300° F. is used.

It will be appreciated that with the box 16 packed and the transformer spaced therefrom with its secondary leads of a high temperature, double insulated type, thermal conductivity between high and low temperature portions of the circuitry is minimized. The cabinet 14 has louvered ports 28.

In practice, the heating coil wire has a resistance of 8 ohms per foot and its length is in the approximate range of twenty to thirty inches. The wire is approximately one-sixteenth of an inch in width and 0.0113 inch in thickness. The length of the coil is desirably in the approximate range of from four to seven inches. The overall resistance of the heating coil wire is approximately two ohms. The voltage and amperage of the secondary current is such that the temperature of the coil 21 is self-limiting at the selected temperature the approximate range of which is 70° F. to 175° F. since the oil heating chamber 17 is upstream relative to the pump 12. A box 29 is attached to one end of the cabinet 14 to which an end of a two wire cable 30 is secured by a connector 31. The cable 30 is connected to a 110 volt AC power supply through the switching means, not shown, by which the operation of the oil burner unit is controlled so that the heating coil 21 is energized whenever the oil burner unit is operated. One wire 32 of the cable 30 is connected through a fuse 33 and a manually operated safety switch 34 to a doubleinsulated lead 35. The other cable lead 36 is connected to another double insulated lead 37 which and the lead 35 extend into the cabinet 14 and are secured thereto by a connector 38 and both are solder-connected to the leads of the primary of the transformer 15. Leads 39 and 40 from the secondary of the transformer are connected to an indicator light 41 mounted on the exterior of the cabinet 14.

Figure 3A:
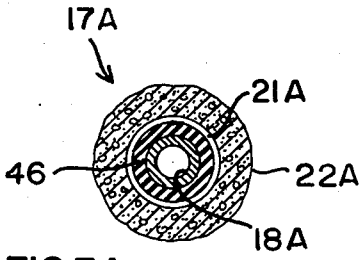
FIG. 3A is an end cross section through the heating chamber 17A of FIG. 3 showing the layers 22A, 21A, and 46 on tubular core 18A.
Figure 2B:
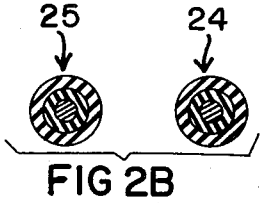
FIG. 2B is an end cross section looking at the double insulated lead wires 24 and 25 leading from transformer 15 of FIG. 2.
Figure 2A:
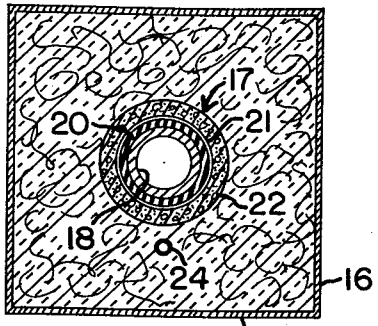
FIG. 2A is an end cross section in the direction of the arrows on line A—A of FIG. 2.
Figure 3:
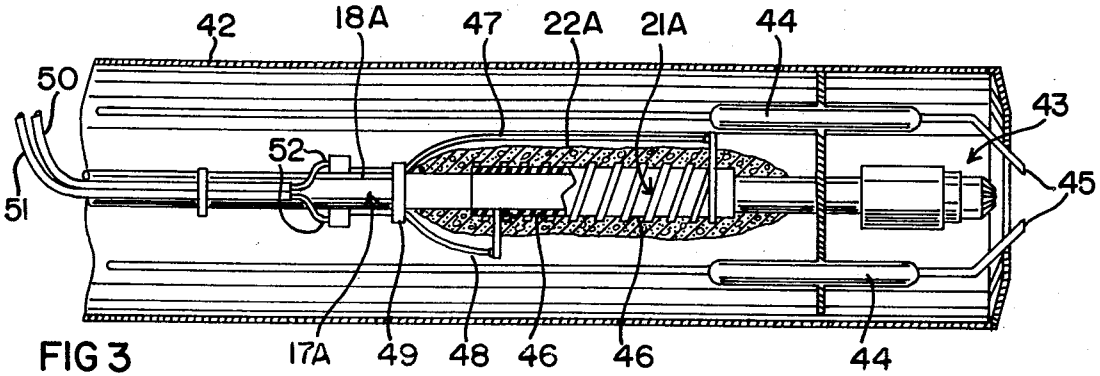
FIG. 3 is a fragmentary lengthwise partial section of the housing for the burner nozzle in accordance with another embodiment of the invention with the elongated oil heating chamber incorporated in the fuel line close to the nozzle and with the heating chamber 17A partially cut away to show the layers formed on tubular core 18A.

The embodiment of the invention illustrated by FIGS. 3 and 3A is generally similar to that just described and corresponding parts are not again detailed but are identified by the suffix addition "A" to the appropriate reference numerals.

In FIGS. 3 and 3A, the elongated heating chamber 17A is within the housing 42 of the nozzle 43 of the oil burner unit. The core 18A of the chamber 17A is the oil conduit connected to the nozzle 43 and the oil heating portion thereof is located as close to the nozzle as its cross sectional dimensions and the nozzle housing permit.

The insulation between the coil 21A and the core 18A is a sleeve 46 of one-eighth inch thick porcelain halves dimensioned, when assembled about the core 18A to be in thermal contact therewith. The outer layer 22A may be hand formed of a quick drying insulating material such as any high temperature furnace cement.

The coil 21A is or may be identical to the coil 21 with its ends connected to high temperature, double insulated leads 47 and 48 and held against the core 18A by a strap 49. The leads 50 and 51 of the cable, not shown, leading from the transformer are joined to the leads 47 and 48, respectively, by connectors 52 of the quickly released type. The transformer is an 18–24 volt, 5–7 ampere power supply for the coil 21A which, with the total resistance of the coil results in the temperature of the coil being self-limiting throughout the selected temperature in the 70° F. to 750° F. range.

Figure 4:
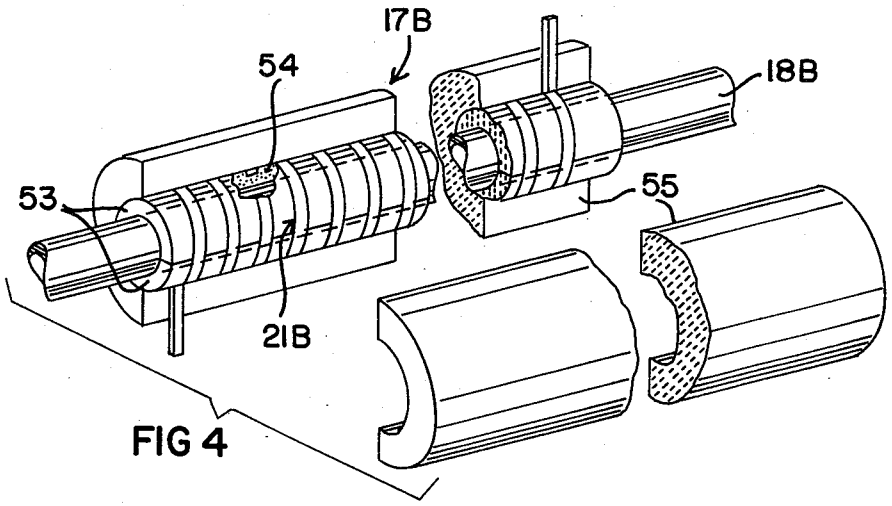
FIG. 4 is a partly sectioned exploded view of an elongated oil heating chamber of a modified construction.

In FIG. 4, in which corresponding parts are indicated by the same reference numerals distinguished by the suffix addition "B", there is shown coil insulation consisting of an inner porcelain sleeve 53 the wall thickness of which may be one-eighth of an inch and formed from two half sections dimensioned, when fitted about the core 18B of a heating chamber in accordance with the invention to be in thermal contact therewith. The sleeve 53 has a helical channel 54 extending from end-to-end thereof dimensioned to accommodate the wire of the coil 21B and to facilitate the winding of the coil. An outer porcelain sleeve 55 consisting of half sections about a quarter of an inch thick and dimensioned to fit against the inner sleeve 53 when assembled thereabout. With the coil formed in the helical channel 54 and the sleeves encasing the coil, the assembly is bonded together.

I claim:

1. A heater for No. 2 fuel oil to ensure a predetermined condition thereof at the orifice of a burner unit and adapted to constitute an elongated section of an oil conduit through which oil is supplied by the pump of the burner unit, said heater comprising an open-ended tubular metal core defining an elongated chamber, a helical heating coil of high temperature durability alloy wire of predetermined length surrounding said core and in heat-transferring relation thereto, means electrically insulating said core from said coil and constituting at least one coat of porcelain-like cement on the portion of the core underlying said coil with the exterior of which said coil is in continuous contact, and electrical and thermal insulating means comprising a coating of a refractory-type cement of lower conductivity than said coat encasing the exterior of said coil, and a 12 to 24 volt, 4–7 amp transformer the secondary of which is connected to said coil and provides a current the voltage and amperage of which is such in relation to the total resistance of the coil that the temperature of the coil is self-limiting and in the approximate range of from 70° F. to 175° F., said core defining elongated chamber constructed and arranged to be located close to but on the upstream side of the pump of a burner unit.

2. The heater of claim 1 wherein the coil is formed with a resistance per unit length and overall length to afford overall resistance of approximately two ohms.

3. The heater of claim 1 wherein the heating coil resistance wire is of a flat ribbon configuration.

4. The heater of claim 3 in which said ribbon is "Kanthol D" alloy approximately one-sixteenth of an inch in width and 0.0113 inch in thickness.

5. The heater of claim 1 wherein the heating coil wire has a resistance in the vicinity of 0.8 ohms per foot and a length in the approximate range of twenty to thirty inches.

6. The heater of claim 5 in which the length of said chamber is in the approximate range of four to seven inches and has the inside diameter of the core approximately five-sixteenths of an inch.

7. The heater of claim 1 wherein the inside diameter of the core is at least equal to the inside diameter of an oil delivery conduit in which it is to be incorporated.

8. The heater of claim 7 and an elongated box through which the core extends and which confines that portion of the core provided with the heating coil, high temperature, double insulated lead wires extending into said box from the secondary of the transformer, each mechanically connected to the appropriate end of the wire of said heating coil.

9. The heater of claim 8 in which said box is packed with high temperature insulation.

10. The heater of claim 9 and an indicator light connected to the secondary of the transformer and mounted on the exterior of the elongated box.

* * * * *